US005882051A

United States Patent [19]

Dreger et al.

[11] Patent Number: 5,882,051

[45] Date of Patent: Mar. 16, 1999

[54] KNOT-TIEING DEVICE AND METHOD OF KNOTTING THEREWITH

[76] Inventors: Kurt W. Dreger; Leah N. Dreger, both of 2012 Carpinteria Dr., Antioch, Calif. 94509

[21] Appl. No.: 681,262

[22] Filed: Jul. 22, 1996

Related U.S. Application Data

[63] Continuation of Ser. No. 40,272, Jun. 14, 1995, Pat. No. Des. 372,663.

[51] Int. Cl.[6] ..... D03J 3/00

[52] U.S. Cl. ..... 289/17

[58] Field of Search ..... 289/1.5, 2, 17, 289/18.1

[56] References Cited

U.S. PATENT DOCUMENTS

| | | | |
|---|---|---|---|
| 3,572,788 | 3/1971 | Cruzan | 289/17 |
| 4,510,653 | 4/1985 | Semanko | 289/17 |
| 4,989,906 | 2/1991 | Peverley | 289/17 |
| 5,039,142 | 8/1991 | Muma | 289/17 |
| 5,098,137 | 3/1992 | Wardell | 289/17 |
| 5,104,160 | 4/1992 | Cheng | 289/17 |
| 5,314,217 | 5/1994 | Place | 289/17 |

*Primary Examiner*—Michael A. Neas

*Attorney, Agent, or Firm*—Walter H. Dreger; Michael A. Kaufman

[57] ABSTRACT

A unitary construction hand-holdable device for tieing an inflated balloon includes projecting spaced-apart first and second prongs, and defines an opening providing finger access to the region rearward and beneath the prongs. An inflated balloon is held beneath the device, and the balloon neck is stretched to pass over both prongs and is then pulled down, below the device. The neck is then crossed over itself and a knot is formed in the region generally below the access opening. After tieing, the knotted balloon is slid off on the prongs. The device may be used to tie elastic materials other than balloons.

11 Claims, 4 Drawing Sheets

KNOT-TIEING DEVICE AND METHOD OF KNOTTING THEREWITH

This application is a continuing application under 35 USC § 120/121 of patent application Ser. No. 29/040,272, filed 14 Jun. 1995, entitled KNOTTIEING DEVICE now U.S. Pat. No. 372,663.

FIELD OF THE INVENTION

The present invention relates to improvements for tieing knots, especially in elastic material. The invention takes its primary form, in its several aspects, of a device that facilitates the tieing of knots, preferably of an elastic material, that is simple in design and use. It further relates to a method of tieing a knot using the device hereof.

BACKGROUND OF THE INVENTION

Consumers purchase inflatable balloons throughout the year to celebrate birthdays, holidays, graduations, promotions and just about any other significant event in their lives. The overwhelming majority of these balloons end up being tied by hand, a tedious and sometimes painful chore which becomes more of a burden as the number of balloons needing to be tied increases.

Most people will not mind tieing a few balloons now and then but when faced with the task of tieing perhaps dozens needed for a particular event most people will ask for assistance.

Tieing balloons over a sustained period of time can be quite painful. Sore fingers and pinched skin are the most common ailments. The balloon material becomes extremely tight when stretched making it difficult to loop a knot. Furthermore, the elastic material is adhesive to itself and to human skin creating inertia to movement across the finger.

Finally, tieing balloons by hand requires a fairly high degree of hand and finger dexterity. Elderly people, children and persons with arthritis have a difficult time tieing balloons.

In a society which values convenience and the avoidance of tedium, consumers need help tieing balloons. The consumer market clearly needs a clever, simple, low cost specialty tool designed specifically to make balloon tieing easier, faster and less painful. The present invention is directed to a device that has been designed to fill this need.

Currently, there are no known specialty tools specifically designed for tieing balloons for the household market. However, there are alternative and substitute products available, such in clips, disks and tape. None of these facilitate tieing the balloon neck which advantageously provides a more secure seal. In addition, we are aware of U.S. Pat. No. 4,989,906 ('906; issued 5 Feb. 1991) and to U.S. Pat. No. 5,039,142 ('142; issued 13 Aug. 1991) which are directed to knot-tieing tools. The tools described in these patents differ considerably from the device of the present invention.

The '906 patent is designed to mount directly on a standard helium or compressed air tank. This device is immovable once in place. It appears to assist in tieing a knot in the neck. The '142 patent illustrates a tool somewhat similar to an embodiment hereof. It is designed to be a hand-held knot tieing tool. It utilizes an elongated handle and a series of slots and holes to guide the neck through tieing.

SUMMARY OF THE INVENTION

The present invention involves a device useful for tieing knots which comprises a substantially trapezoidally shaped donut-like structure having a bottom member, a top member and two side members, said bottom member having gripping means to facilitate rigidly holding said device while in use between a user's thumb and finger; complementary prong means at the top of said structure suitably spaced to act as resistance when the material to be knotted is wrapped individually and diagonally around said prong means; and one each of said gripping means and prong means being diagonally spaced relative another.

To define the invention further: A knot-tieing device useful for facilitating manually tieing a knot in an elastic material comprising a body having a top side and an opposite bottom side, said sides being connected so as to define a generally trapezoidal opening extending therethrough from said top side to said bottom side; a first prong member extending outwardly from said body proximate one side thereof at or near the top side; and a second prong member extending outwardly from said body proximate an opposite side thereof at or near the top side; said prong members being spaced apart and extending generally in the same direction away from said bottom side; said first and second prong members being of a sufficient dimension to support said elastic material thereon such that a central portion of said elastic material extends transversely across the body bottom side from said opening, a middle portion of said elastic material continuous with said central portion extends around said first prong and across said top side to said second prong member, and an end portion of said elastic material continuous with said middle portion extends back around said second prong and across said bottom side to intersect said central portion proximate said opening; and said opening being positioned sufficiently rearward of said prong members to enable manipulation of the distal end of the end portion of said elastic material to loop around said central portion at the intersection and draw through a center of the formed X-shape to form the knot.

The present invention is useful for tieing knots in any material but finds particular application for tieing knots in elastic material that is difficult to achieve by hand without assistance of some sort. While the invention in its broad aspects is directed to a device and method of tieing knots generally, particular focus in a preferred embodiment is for elastic materials, and for purposes of defining the invention with respect to a specific example, the present specification refers to the tieing of balloons. It will be understood, however, that the device and method hereof could find application in a myriad of other situations where it is desired to tie knots in elastic materials.

The invention has been described above in both functional and structure language. It will be understood that structure that is equivalent to that specifically defined can be used so long as said structure is adapted to the functional use. For example, the prong means could be any structure that serves to impart resistance to the elastic material when wrapped around the structure. Similarly, the top, bottom and two side portions that define an opening is generally described as trapezoidal in shape so as to facilitate the dexterity of one's fingers in actually tieing the knot in the elastic material by looping the free end of the elastic material over one side of the formed X. Similarly, the gripping means that are described with respect to the bottom side have been defined as thumb wells or depressions in a preferred embodiment. It will be understood that any equivalent means that would function to secure to the user of the device a firm and rigid gripping of the device to facilitate the knot tieing is also covered within the equivalent scope of the present invention.

Basically, the device hereof requires a support member defined herein as well as a top side that rigidly affixes the two-prong means to the device as a whole. The device also defines a knotting hole which is employed to facilitate the actual knot-tieing process when the device is in use by defining an X with the elastic material within the hole.

The distance between the prongs is important; the distance should not be too great so as to overstretch the neck of the balloon, the stretching length. The distance between the prongs should not be too small so as to prevent finger intrusion into the knotting hole to form the knot by pulling said elastic material from under the device. In addition, the distance from the thumb grasping portion of the device diagonally to the prongs should not be too great so as to create over-stretching of the elastic material. Generally, a trapezoidal shape, in the preferred embodiment, accommodates the above structure to facilitate ease and simplicity in use.

Again, the figures illustrate one embodiment of a device hereof that is useful for the tieing of knots, particularly in elastic material.

DETAILED DESCRIPTION AND EXAMPLE

Reference is directed to the figures and more particularly to FIGS. 6 to 10 which show the device 10 in operation with respect to a balloon 20 as elastic material. The device is used generally as follows. The balloon is first inflated by any conventional means. Grasping the device, in either hand, with a thumb in a thumb well 30 and the prongs 45,50 pointed away from the grasping hand, the base of the balloon neck is placed under the device and respective thumb well. The thumb well is then grasped by the grasping hand with the device on top and the balloon firmly affixed to the bottom of the device under the thumb and held in place by the forefinger.

Figure 1:
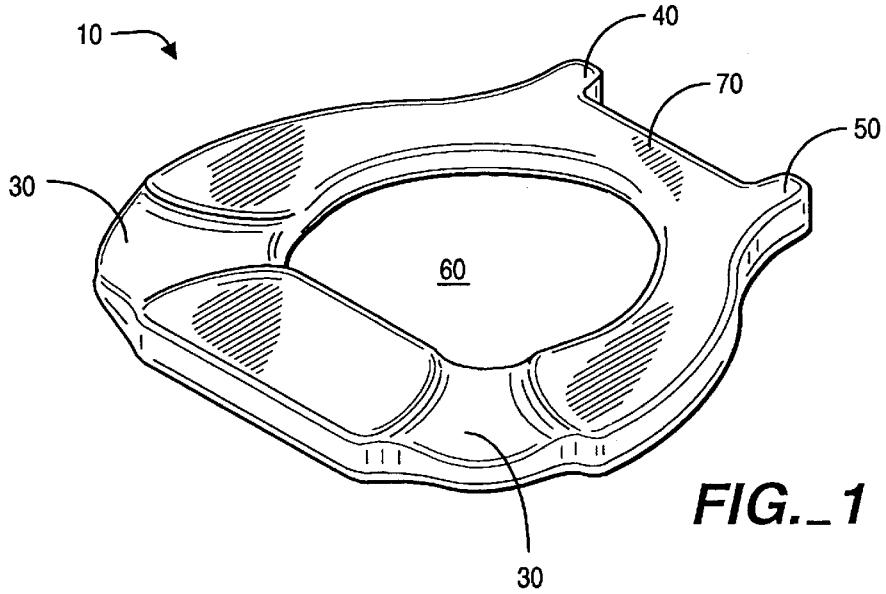
FIG. 1 is a top perspective view of a knot tieing device showing the new design.
Figure 2:
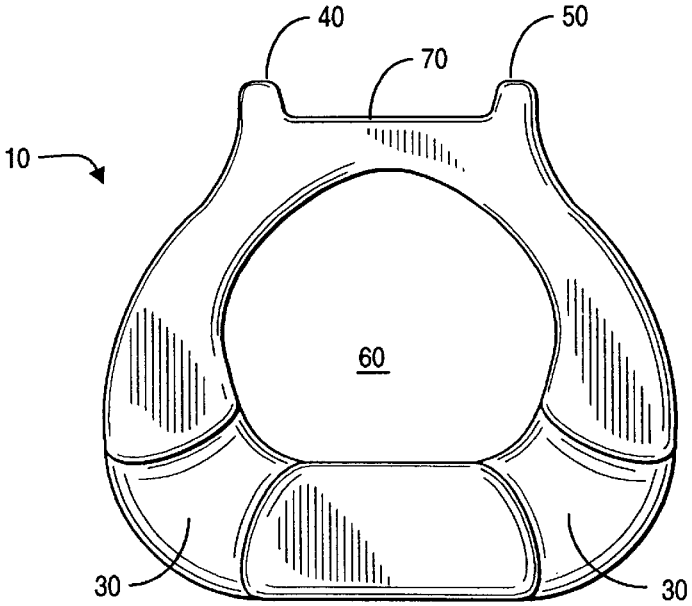
FIG. 2 is a top plane view of one side of the device, the bottom plan view being a mirror image of the top plane view.
Figure 3:
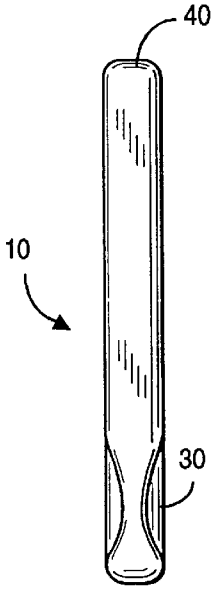
FIG. 3 is a side elevation view of one side of the device, the other side being a mirror image of the first side.
Figure 4:
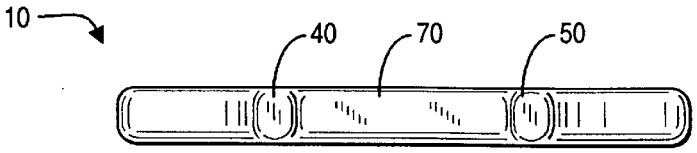
FIG. 4 is a front elevation view of the device.
Figure 5:
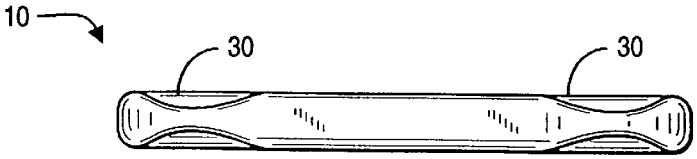
FIG. 5 is a rear elevation view of the device.
Figure 6:
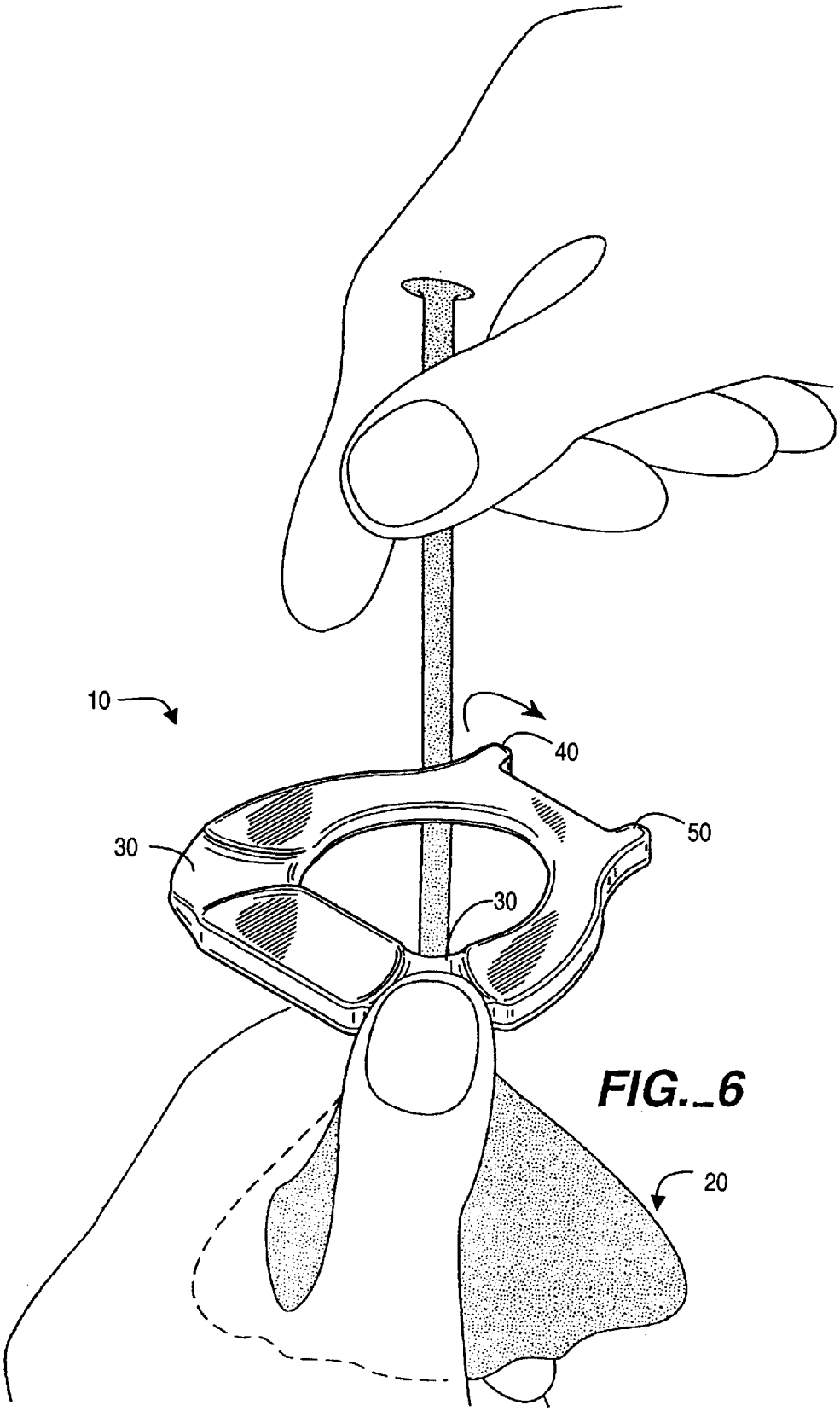
FIGS. 6 to 10 represent fragmentary top perspective views of the device, illustrating use thereof in the process of tieing a balloon, as elastic material, via the use of phantom lines.
Figure 7:
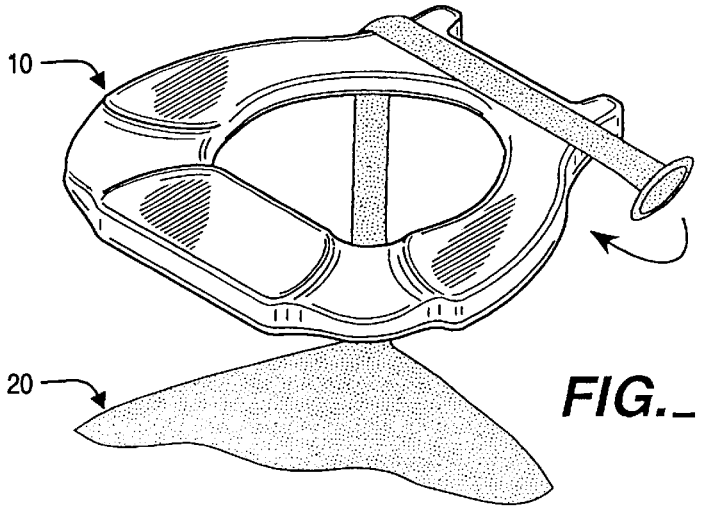
Figure 8:
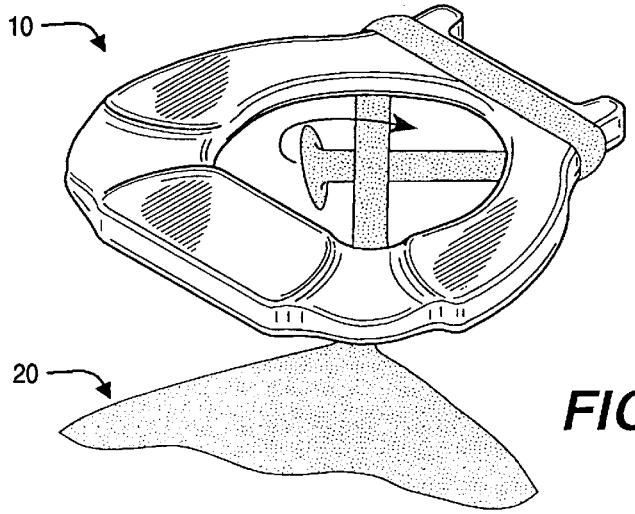
Figure 9:
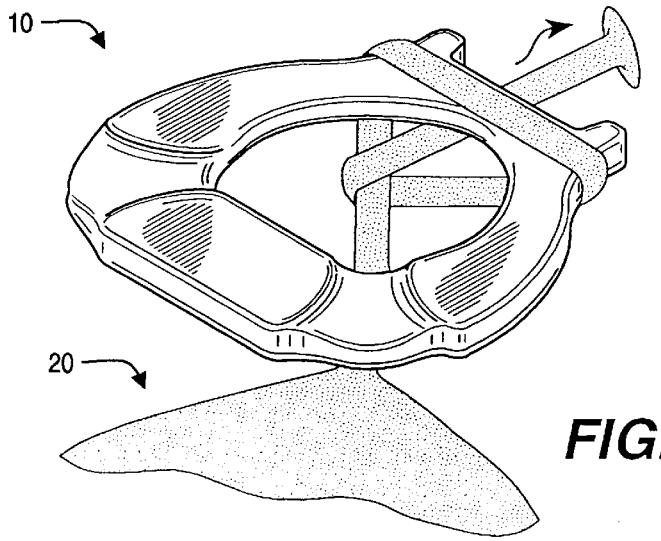
Figure 10:
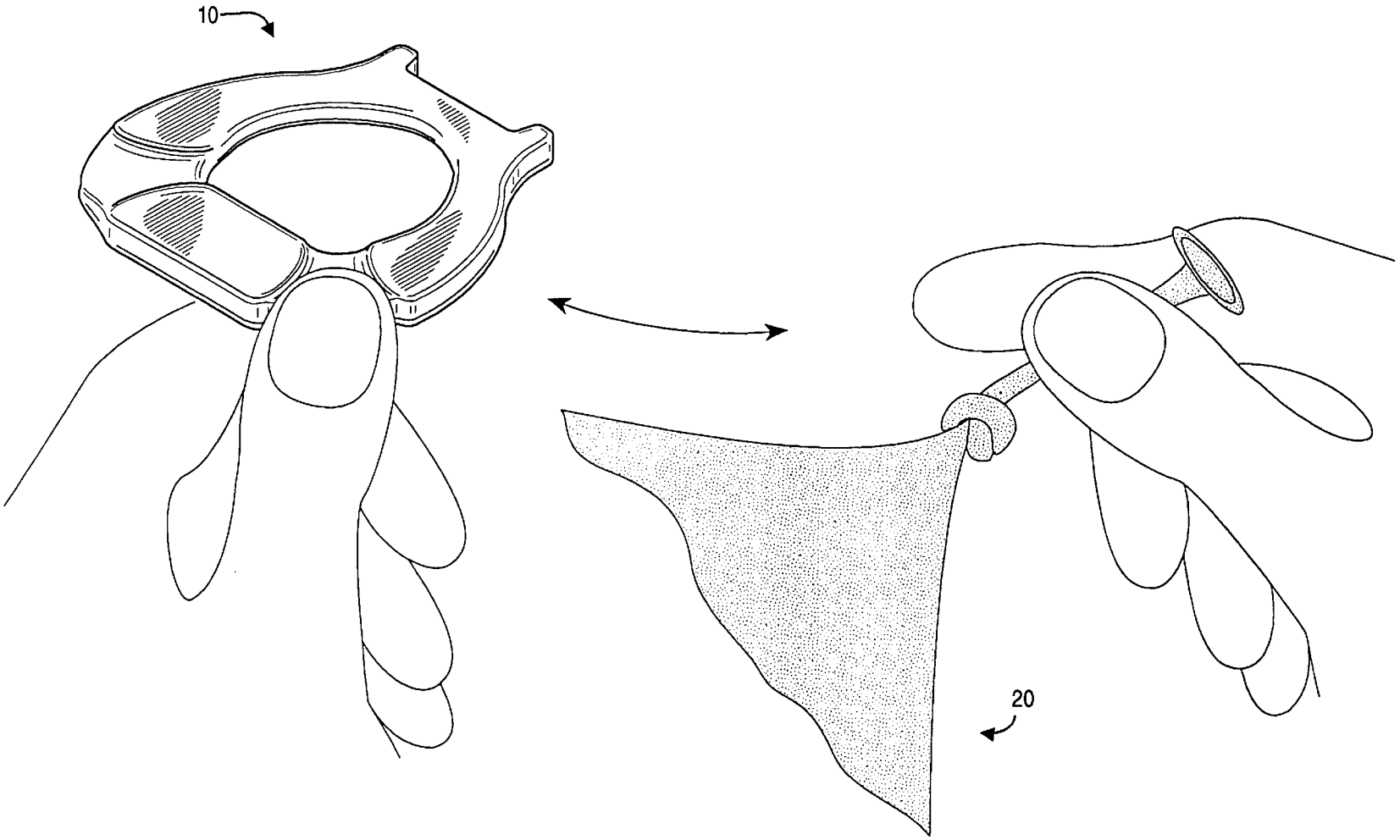

The free end of the balloon neck is stretched with the other hand diagonally from the grasping thumb well towards the opposite prong (FIG. 6). With the balloon neck stretched out fully, using the prong as a resistance device, the neck of the balloon is brought over the top of both prongs and back under the tool towards the other thumb well that is not currently being used (FIGS. 7 and 8). By looking through the knotting hole, the user sees an X having been formed by the balloon neck. The end of the balloon neck is pushed over the X and rolled into the finger and thumb of the hand that is not grasping the device (FIG. 9). The end of the balloon is then pulled out from under the structure separating the prongs (stabilization bar) 70 and away from the prongs, as depicted in FIG. 10. Simultaneously, the balloon is released from the device and the user is holding a tied balloon. This process can be repeated over and over with minimal tedium and pain.

The thumb wells indicate where the thumb should be when gripping the tool and they act as a guide for positioning the inflatable balloon. The handle area that defines the grasping means represents the end that should be grasped when using the tool, leaving the end containing the prongs free. The prongs act as a guide for rolling the balloon from the tool when tied. The prongs provide the resistance to stretch the balloon neck to its fullest extent during the tieing process. The stabilization bar that separates and supports the prongs provides the correct spacing to produce the correct stretching distance for the tieing process. The knotting hole provides a maneuverability area for thumb and forefinger during the tieing process.

CONCLUDING REMARKS

The present invention has been defined with respect to certain specific details for a preferred design. Again, although such specific details and design have been provided, it will be well enough within the skill of the art to design other shapes that would generally function as does the preferred embodiment hereof. Thus, while the invention has been defined and described with respect to certain details, it will be understood that the interpreted scope of this invention is to be defined only by the lawful construction of the appended claims.

What is claimed is:

1. A knot-tieing device useful for facilitating manually tieing a knot in an elastic material comprising:

a) a body having a top side and an opposite bottom side and defining a generally trapezoidal finger-access sized opening extending therethrough from said top side to said bottom side;

b) a first prong member extending outwardly from said body proximate one side thereof near said top side; and c) a second prong member extending outwardly from said body proximate an opposite side thereof near said top side, said second prong member being spaced apart a lateral distance from said first prong member to define a single space therebetween exceeding about 20% of a largest width of said body and permitting a user to tie a distal end portion of said elastic material and extending generally in a same direction away from said bottom side;

d) each of said first and second prong members being of a sufficient dimension to support said elastic material thereon such that a central portion of said elastic material extends transversely across said bottom side away from said opening, a middle portion of said elastic material continuous with said central portion extends around the first prong member and across said top side to the second prong member, and an end portion of said elastic material continuous with said middle portion extends back around said second prong member and across said bottom side to intersect said central portion proximate said opening, said lateral distance being sufficiently large to permit elastically stretching said elastic material across said first prong member and across said second prong member without being so large as to render said device mechanically unstable; and e) said opening being positioned sufficiently rearward of said first and second prong members to enable manipulation of a distal end portion of said elastic material to loop around said central portion at an intersection and draw through a center of a formed triangle to form a knot.

2. The device according to claim 1 wherein said elastic material is a neck of a balloon.

3. The device according to claim 1 further including gripping means on said bottom side.

4. The device according to claim 3 wherein said gripping means forms a depression for accommodating a thumb of a user.

5. The device according to claim 1 wherein said prong members extend outwardly from said top side substantially parallel to each other.

6. A method for tieing a knot in an inflated balloon, comprising the following steps:

(a) providing and holding in one hand a one-piece hand-holdable member having first and second spaced-apart prongs projecting from a distal portion of said member, said prongs being spaced-apart a lateral distance defining a single space therebetween exceeding about 20% of a maximum width of said member permitting a user to tie a knot in a neck portion of said balloon, and defining an opening through a portion of said member, said opening sized to provide access for a finger of said user's free hand therethrough;

(b) disposing said balloon beneath said member;

(c) using said free hand, stretching a distal neck portion of said balloon upward, across each of said prongs, and then downward;

(d) using said free hand, crossing said distal neck portion beneath said member with a less distal portion of said neck portion such that a generally X-shaped cross is defined when viewed through said opening;

(e) using said free end to form a knot in said neck portion; and (f) removing said neck portion from said member.

7. A device for tieing an inflated balloon, comprising:

a one-piece hand-holdable member having first and second spaced-apart prongs that each project from a distal portion of said member at least a projection distance sufficiently long to permit stretching a neck of an inflated balloon across said prongs, and further defining an opening through a portion of said member, said opening sized to provide access for a user's finger therethrough for tying said neck of said inflated balloon;

said prongs being spaced-apart a lateral dimension defining a single space therebetween exceeding about 20% of a maximum width of said body, without rendering said device mechanically unstable, to permit said user to tie said neck of said inflated balloon such that said neck of said inflated balloon may be elastically stretched across said prongs.

8. The device of claim 7, wherein said prongs are substantially parallel to each other.

9. The device of claim 8, wherein said prongs project substantially parallel to a plane of said member.

10. The device of claim 7, wherein said prongs are substantially parallel to each other and to a plane of said member, and extend from an upper surface region of said member.

11. The device of claim 7, wherein said opening defines a generally trapezoidal shape when viewed from an upper surface of said member.

* * * * *